United States Patent [19]

Wohlford

[11] 4,038,903

[45] Aug. 2, 1977

[54] TWO STAGE TELESCOPED LAUNCHER

[75] Inventor: William P. Wohlford, Bettendorf, Iowa

[73] Assignee: The United States of America as represented by the Secretary of the Army, Washington, D.C.

[21] Appl. No.: 716,842

[22] Filed: Aug. 23, 1976

[51] Int. Cl.[2] ..... F41F 1/00

[52] U.S. Cl. ..... 89/8; 89/1.7; 89/7

[58] Field of Search ..... 89/8, 1 B, 1.7, 7; 60/632

[56] References Cited

U.S. PATENT DOCUMENTS

| | | | |
|---|---|---|---|
| 477,946 | 6/1892 | Livingston et al. | 89/8 X |
| 3,013,472 | 12/1961 | Kahn et al. | 89/8 X |
| 3,204,527 | 9/1965 | Godfrey et al. | 89/8 |
| 3,311,020 | 3/1967 | Piacesi et al. | 89/8 |
| 3,465,638 | 9/1969 | Canning | 89/8 |
| 3,763,740 | 10/1973 | Fletcher et al. | 89/8 |

FOREIGN PATENT DOCUMENTS

| | | | |
|---|---|---|---|
| 917,369 | 1/1947 | France | 89/8 |

*Primary Examiner*—David H. Brown

*Attorney, Agent, or Firm*—Nathan Edelberg; Harold H. Card, Jr.; Robert O. Richardson

[57] ABSTRACT

A two stage telescoped launcher wherein propellant compresses a gas which in turn ejects a projectile from a gun launch tube. The two stages are telescoped to shorten the gun and to permit breech loading of the projectile.

5 Claims, 6 Drawing Figures

TWO STAGE TELESCOPED LAUNCHER

GOVERNMENT RIGHTS

The invention described herein may be manufactured and/or used by or for the Government for governmental purposes without the payment of any royalty thereon.

BACKGROUND OF THE INVENTION

As military targets, such as aircraft, become faster and more maneuverable, they become more capable of avoiding or outrunning the projectiles that are fired to intercept them. The military, therefore, to meet its mission, must improve its gun systems by reducing the time required for a projectile to reach its target from the instant of launch. Numerous techniques are used in laboratories to launch projectiles at very high velocity. Heretofore, these methods have required excessively large or short lived, expendable launchers which are not conducive to conversion to military use. One of the most common and highly developed of these laboratory launchers is the two stage light gas gun.

The commonly known two stage launcher has a gas pump tube and launch tube which are longitudinally disposed. Within the gas pump tube is a piston separating the propellant and the gas. The propellant pumps the piston against the gas behind the projectile in the launch tube. When compressed sufficiently, the gas ejects the projectile from the launch tube. This tandem arrangement of two tubes is excessively long and results in projectile placement at a point far removed from the breech of the gun.

SUMMARY OF THE PRESENT INVENTION

The present invention utilizes the basic operation of the two stage gun and applies it in a telescoped geometry which effectively reduces gun length and provides an accessible breech which is easily loaded and automated to fire projectiles at much higher velocities than is current practice.

Two methods are provided by which the two stage launcher can be converted for military or compact application. Both of these methods, when compared to conventional two stage guns, are about one-third shorter and by virtue of their telescoped geometry present the point of loading for both the solid propellant and the projectile at the breech where it is easily accessible to hand loading or for application of automated mechanisms. With drastically reduced length and accessible loading, the two stage launch technique can be utilized to accelerate projectiles to very high velocities in compact systems.

The first method has a longitudinally movable barrel that is telescoped inside the pump tube and has a piston attached to its breech end. This geometry utilizes the barrel mass as an inertial component.

The second method also utilizes a telescoped geometry, however, it has the piston detached from the barrel and facilitates loading only after the piston is removed from the gun along with the breech closure. This concept is equivalent in performance to the above while it has the added advantages of a static barrel, shorter final length and elimination of the need for the highly stressed piston to barrel interface. It has a natural cancellation of recoil forces by virtue of its reverse acting piston.

These concepts are similar in operation to the conventional tandem two stage gun. They use ordinary gun propellant to accelerate a piston which compresses an intermediate gas whose expansion, then, accelerates the projectile. The use of low molecular weight gas as the intermediate gas allows the gas velocity and, therefore, the projectile velocity to reach much higher levels.

BRIEF DESCRIPTION OF DRAWINGS

FIG. 6 is a sectional view of a round of ammunition for use in a second embodiment launcher.

DETAILED DESCRIPTION OF ILLUSTRATIVE EMBODIMENTS

Figure 1:
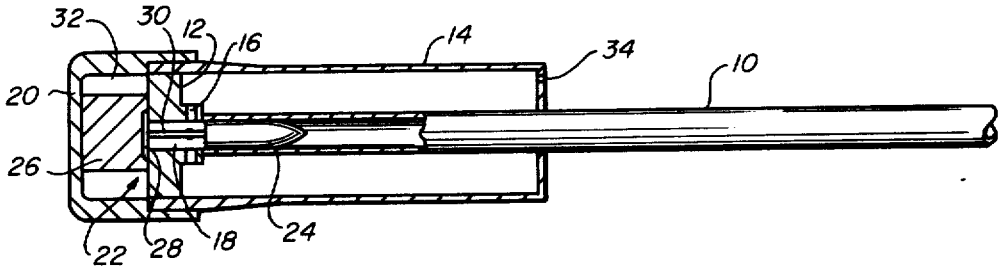
FIG. 1 is a schematic illustration of a first embodiment of a two stage telescoped launcher in loaded and ready-to-fire condition.
Figure 2:
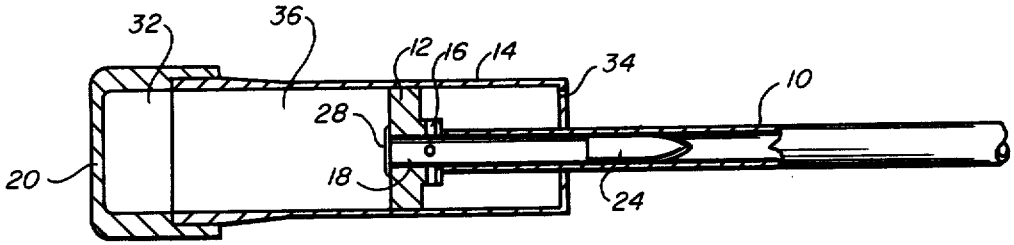
FIG. 2 is a schematic illustration of the same embodiment as the projectile is being launched.

The first embodiment of the present invention is illustrated in FIGS. 1 and 2. FIG. 1 is a schematic configuration of the gun in the loaded and ready-to-fire phase. The gun consists of a cylindrical tube or a barrel 10. The barrel 10 is rigidly attached to a piston 12 and the resultant piston/barrel assembly 12/10 is fitted into a pump tube 14 such that the piston/barrel assembly 12/10 is free to move longitudinally within the pump tube 14. The piston/barrel assembly has radial holes or gas ports 16 near the piston 12 which allows free passage of gas through the wall of barrel 10. The piston/barrel assembly has a central axial hole 18 which permits access to the bore of barrel 10 from the breech end of the gun. A breech block 20 is provided which encloses the breech end of the pump tube 14 in a sealed but removable manner. A munition 22 is provided which consists of a projectile 24, a propellant mass 26 and a seal plug 28. The seal plug 28 is so configured that it serves as a means to attach the propellant 26 and projectile 24 together and, further, to provide a break valve 30 and seal between the piston 12 and propellant chamber 32.

The loaded condition of the launcher in FIG. 1 shows the gun components at a point where the barrel/piston assembly 10/12 is in a far rearward position, the munition assembly 22 is in place, and the breech block 20 is closed. The pump tube 14 is charged with a low molecular weight gas through the load valve 34 which is, then, closed.

FIG. 2 shows a point in the launch process where the barrel/piston assembly 10/12 is in motion in the forward direction and the projectile 24 is in motion within the barrel 10, also in the forward direction. At the beginning of the launch phase, the propellant 26 is ignited in the conventional manner. The burning of the propellant 26 releases hot, expanding gases 36 which propel the piston/barrel assembly 12/10 forward. The forward inertia of the piston/barrel assembly 12/10 causes a rapid compression of the gas in the pump tube 14. This energized gas flows through the gas ports 16 to fill the volume between the seal plut 28 and the base of the projectile 24. The gas pressure rises to a point where the break valve 30 releases and the projectile 24 is propelled down the barrel 10 to be launched at the muzzle. The gun components are so designed that the inertia of the moving barrel/piston assembly 10/12 is entirely converted to projectile energy through the gas. This results in the moving parts being decelerated to stop at the instant the piston 12 nears the front end of the pump tube 14. The seal plug 28 is designed to be expelled down the barrel 10 when differential pressures between the propellant and gas sides of the piston 12 and appropriately balanced. An external spring method or a gas energy reserve (not shown) may be used to return the piston/barrel assembly 12/10 back to its original position.

This configuration has the advantage of breech access for loading and an initially shorter length. It further increases the projectile velocity by the additional barrel velocity. It utilizes the principle of low weight and high sound speed gases to achieve projectile velocities much greater than conventional guns.

Figure 3:
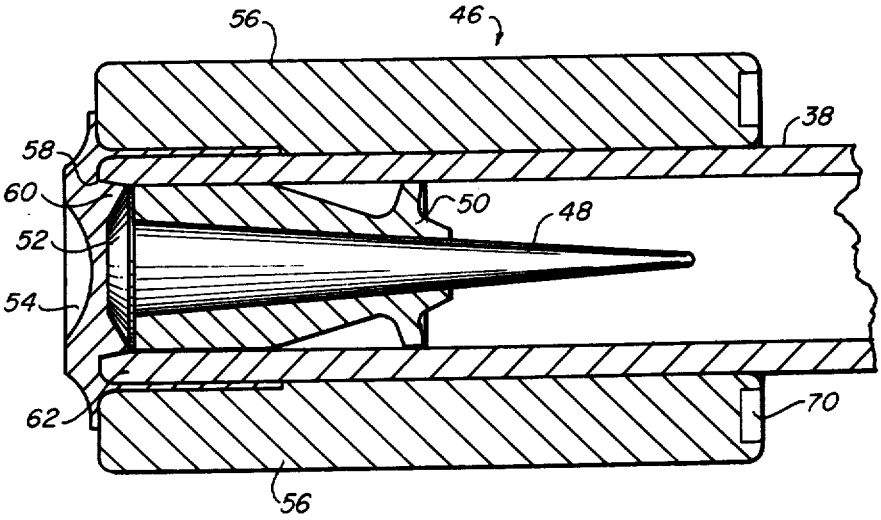
FIG. 3 is a schematic illustration of a second embodiment in loaded condition prior to charging with a gas.
Figure 3:
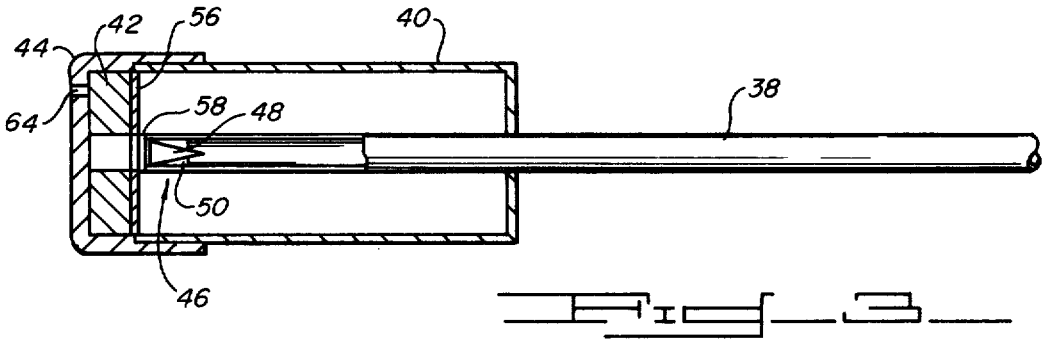
Figure 4:
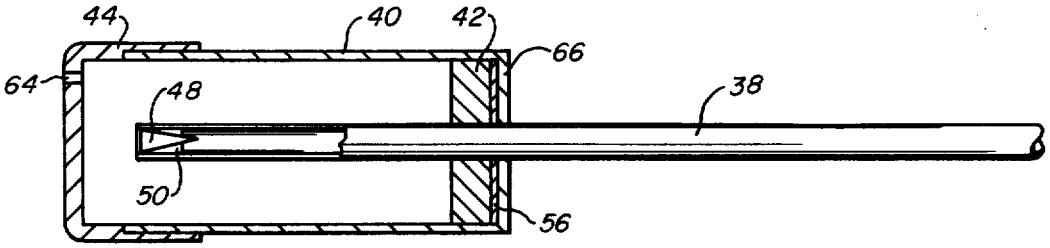
FIG. 4 is a schematic illustration of the second embodiment after it has received a full gas charge.
Figure 5:
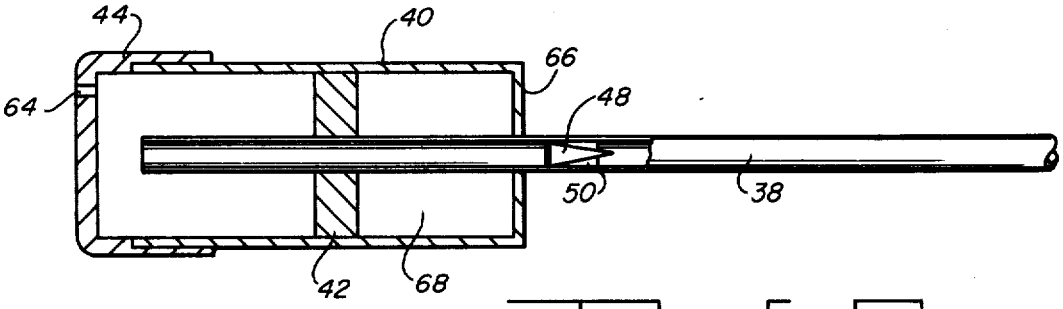
FIG. 5 is a schematic illustration of the second embodiment às the projectile is being launched.

A second embodiment of the present invention is illustrated in FIGS. 3, 4 and 5. FIG. 3 is a schematic configuration of the gun in the loaded condition prior to charging with light gas. The gun consists of a barrel 38 which is telescoped within a pump tube 40. There is no relative movement between the two as in the first embodiment. A piston 42 is assembled which slides freely in the annulus formed by the barrel 38 and the pump tube 40. A breech block 44 is provided which closes and seals the breech of the gun in a removable manner.

A munition 46, shown in FIG. 6, is provided with projectile 48, sabot 50, pusher plate 52, break valve assembly 54 and propellant mass 56. The break valve assembly 54 is so designed as to hold the munition together as a single assemblage. The break valve assembly is further designed to shear free at point 58 under a predetermined load to allow the projectile 48, pusher plate 52 and seal portion 60 of the break valve 54 to move down the barrel 38.

During the loading process the piston 42 is contained and held in the breech block 44. This assemblage is removed from the breech, exposing the breech end 62 of the barrel 38 and the annulus of the pump tube 40. The munition assembly 46 of FIG. 6 is then inserted over the open breech end 62. The breech block 44 with its contained piston 42 is next attached and locked to the pump tube 40. This locking process is designed to achieve a forward movement of the piston 42 sufficient to shear the propellant mass 56 free from the munition assembly 46 and seal the piston 42 in the annulus of pump tube 40 and over the breech end 62 of barrel 38. This loaded condition is shown in FIG. 3.

Charging gas through the gas load valve 64 in breech block 44 moves the piston 42 with the propellant 56 to the forward end 66 of the pump tube 40 as shown in FIG. 4. This leaves the projectile 48 in position at the breech end 62 of the barrel 38.

On command from the gunner or by virtue of pressure or position the propellant 56 is ignited and rapid burning ensures. In one application the impact of primer 70, shown in FIG. 6, against the front wall of the pump tube 40 in the gas charging operation sets it off and ignites the propellant. The combustion gas 68 generated moves the piston 42 rearwardly, as shown in FIG. 5, compressing the light gas in the pump tube 40. This gas pressurizes the base of projectile 48 and propels the projectile 48 forward to launch from barrel 38.

This second embodiment just described provides the advantage of a reduced launcher length in comparison to the first configuration and eliminates the high stress connection between the piston and barrel. It further has a unique kinematic characteristic which allows a partial cancellation of recoil forces by the opposing motion of internal components. It similarly uses the principles of two stage and light gas launching to achieve increased velocity.

The invention in its broader aspects is not limited to the specific combinations, improvements and instrumentalities described but departures may be made therefrom within the scope of the accompanying claims without departing from the principles of the invention and without sacrificing its chief advantages.

What is claimed is:

1. A two stage telescoped launcher comprising a barrel from which a projectile may be launched, a pump tube with piston means therein adapted to exert pressure behind said projectile thereby to launch it from said barrel, and pressure generating means for moving said piston and thus pressurizing said pump tube, said barrel moving forwardly as said projectile is being launched, said barrel extending into said pump tube with said piston affixed thereto, whereby forward movement of said barrel and piston compresses gases in said pump tube to thereby pressurize said pump tube, and wherein said pressure generating means is a propellant moving said piston forward in said pump tube.

2. A two stage telescoped launcher as in claim 1 wherein said barrel has ports therein forwardly of said piston and in communication with the inside of said pump tube.

3. A two stage telescoped launcher comprising a barrel from which a projectile may be launched, a pump tube with piston means therein adapted to exert pressure behind said projectile thereby to launch it from said barrel, and pressure generating means for moving said piston and thus pressurizing said pump tube, said barrel extending into said pump tube, said piston being floatingly mounted for longitudinal movement thereover.

4. A two stage telescoped launcher as in claim 3 wherein said pressure generating means is a propellant mounted over said barrel between said piston and the front of said pump tube whereby said pump tube is pressurized by rearward movement of said piston upon ignition of said propellant.

5. A two stage telescoped launcher as in claim 3 wherein rearward movement of said piston causes forward ejection of said projectile from said barrel.

* * * * *